US005116033A

United States Patent [19]

Honegger

[11] Patent Number: 5,116,033

[45] Date of Patent: May 26, 1992

[54] APPARATUS FOR COLLECTING, ASSSEMBLING AND INSERTING PRINTERY PRODUCTS

[75] Inventor: Werner Honegger, Tann Ruti, Switzerland

[73] Assignee: Ferag AG, Hinwil, Switzerland

[21] Appl. No.: 365,478

[22] Filed: Jun. 13, 1989

[30] Foreign Application Priority Data

Jun. 14, 1988 [CH] Switzerland ..... 02284/88

[51] Int. Cl.[5] ..... B65H 5/30

[52] U.S. Cl. ..... 270/55; 270/57

[58] Field of Search ..... 270/54, 55, 57, 58

[56] References Cited

U.S. PATENT DOCUMENTS

| | | | |
|---|---|---|---|
| 3,481,594 | 12/1969 | McCain et al. . | |
| 3,663,007 | 5/1972 | Preiter | 270/55 |
| 3,774,901 | 11/1973 | McCain | 270/54 |
| 3,938,799 | 2/1976 | Macke . | |
| 3,951,399 | 4/1976 | Reist . | |
| 4,004,796 | 1/1977 | Macke | 270/54 |
| 4,058,202 | 11/1977 | Reist et al. . | |
| 4,118,023 | 8/1978 | Macke | 270/54 |
| 4,408,754 | 10/1983 | Meier . | |
| 4,684,116 | 8/1987 | Hansch . | |
| 4,684,117 | 8/1987 | Honegger et al. . | |
| 4,709,910 | 12/1987 | Honegger . | |
| 4,729,554 | 3/1988 | Honegger . | |
| 4,735,406 | 4/1988 | Weber . | |

FOREIGN PATENT DOCUMENTS 3616566 12/1986 Fed. Rep. of Germany .

*Primary Examiner*—Edward K. Look
*Assistant Examiner*—Therese M. Newholm
*Attorney, Agent, or Firm*—Willian Brinks Olds Hofer Gilson & Lione

[57] ABSTRACT

Supports (18) are provided on a conveyor chain (16), which can be driven in a circulating manner in the conveying direction (F). To the left and right of the conveyor chain (16), guide plates (24, 24') are arranged on a frame (22). One of these guide plates (24) at the same time forms a part of one side flank of the V-shaped receiving part (12). The conveyor chain (28), which can be driven in a circulating manner in the conveying direction (F), is provided in the gap between the lower end of this guide plate (24) and the short flank (32) of the bent guide plate (34), the driving parts (30) fixed to the conveyor chain (28) protruding into the receiving part (12). At the feed locations, printery products (10, 10') can thus be deposited astride onto the supports (18) for collecting or fed into the receiving part (12) for inserting or assembling. These printery products (10, 10') are then taken either by the supports (14, 20) or the driving parts (30) to the next feed location in each case or to the removal location arranged downstream.

12 Claims, 2 Drawing Sheets

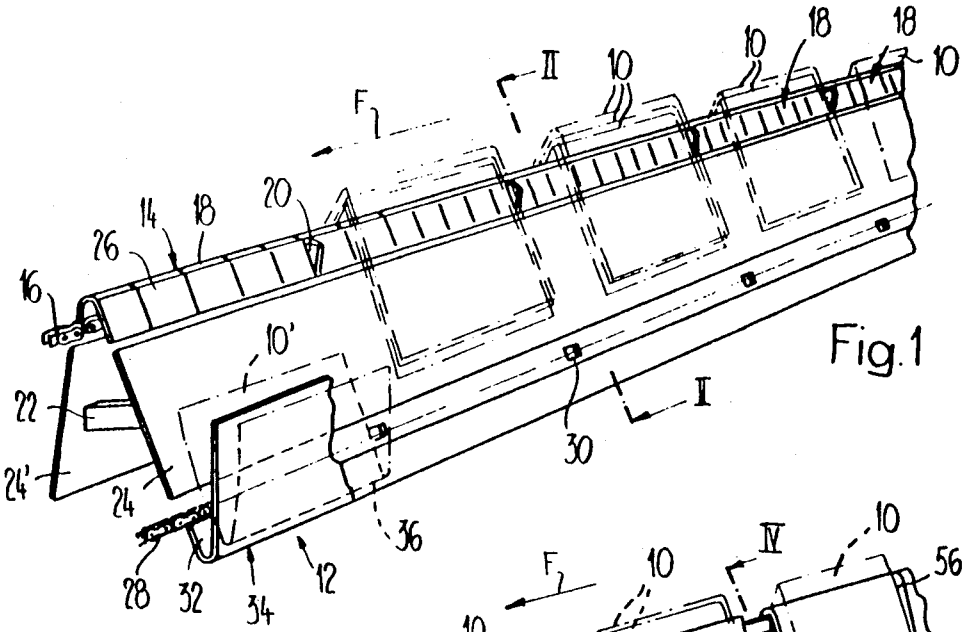
Fig. 1
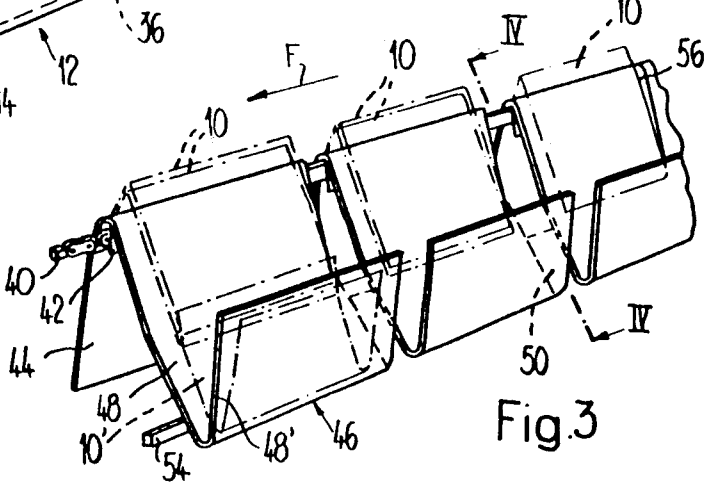
Fig. 3
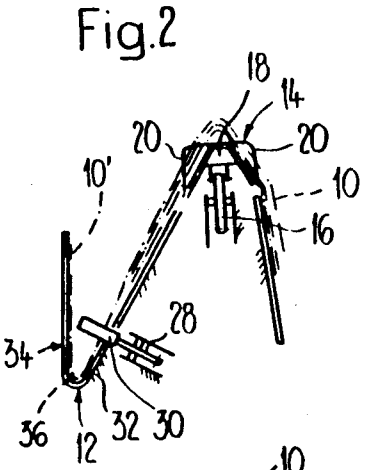
Fig. 2
Fig. 4

APPARATUS FOR COLLECTING, ASSSEMBLING AND INSERTING PRINTERY PRODUCTS

BACKGROUND OF THE INVENTION

The present invention relates to an apparatus for collecting, assembling and inserting printery products according to the preamble of claim 1.

U.S. Pat. No. 3,481,594, for example, discloses an apparatus for collecting printery products. This apparatus has a saddle-shaped support which is arranged along a processing path and is formed by two parallel rails at a distance from one another. Guided between the rails is a conveyor chain which is driven in a circulating manner and on which drivers, protruding beyond the rails, are arranged. A folded printed sheet deposited astride onto the rails at the first feed location is seized by a driver and conveyed to the next feed location, where a further folded printed sheet is deposited onto this first printed sheet. These printed sheets are conveyed together by the driver either to a next feed location or to a removal location.

Often, however, in printeries or in works which process printery products, such as bookbinderies, printery products have to be assembled or inserted one into the other. In such works, both actual collecting apparatuses as well as actual insertion and assembly apparatuses are required. Frequently, therefore, these apparatuses can only be used from time to time.

One object of the present invention is therefore to reduce the plurality of different apparatuses and machines necessary in printeries and in works processing printery products and to increase the utilization of the machines available.

SUMMARY OF THE INVENTION

According to this invention an apparatus is provided for collecting, assembling, and inserting printery products, comprising at least one support, extending in the direction of a processing path, for collecting printery products, which support is operative to support printery products deposited astride the support at two or more feed locations arranged at a distance from one another. Transport means are provided for transporting the deposited printery products along the processing path from the feed locations to a withdrawal location. At least one pocket-shaped receiving part extends in the direction of the processing path and is closed off at a bottom portion such that printery products can be fed into the at least one receiving part at the feed location for assembling or inserting. Conveying means transport the printery products fed into the at least one receiving part along the processing path.

With a single apparatus according to the invention, printery products can thus be collected as well as inserted and assembled. The receiving parts and supports can be firmly mounted on the apparatus. But it is also conceivable for the receiving parts and/or the supports to be removable, as a result of which, after a short change-over time, printery products can be collected, inserted or assembled by the apparatus.

In an especially simple embodiment, the transport and conveying means are identical. This means that a single conveying arrangement is used for transporting the printery products either deposited onto the supports or fed into the receiving parts.

Further preferred embodiments are specified in the further appendant claims.

BRIEF DESCRIPTION OF THE DRAWINGS

The invention will now be described in greater detail with reference to two examples shown in the drawing, in which, purely schematically:

FIG. 1, in a perspective representation, shows a first embodiment of the apparatus according to the invention having moving supports and a fixed receiving part, FIG. 2 shows a vertical section along line II—II in FIG. 1, FIG. 3, in a perspective representation, shows a second embodiment of an apparatus according to the invention having moving supports and receiving parts which can be removed from these supports, and FIG. 4 shows a vertical section along line IV—IV in FIG. 3.

DETAILED DESCRIPTION OF THE PRESENTLY PREFERRED EMBODIMENTS

Figure 5:
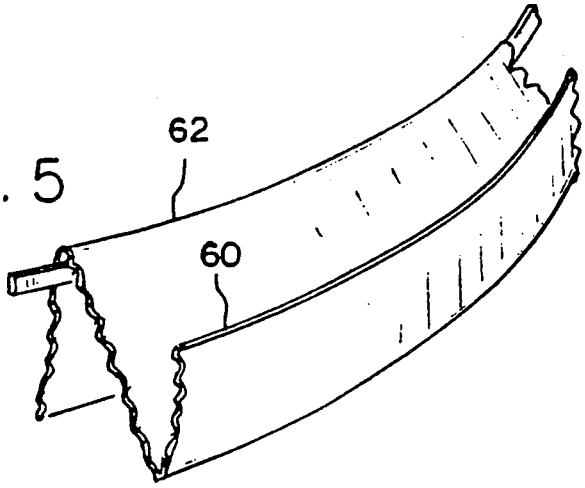
FIG. 5 shows a schematic side view of another embodiment of an apparatus according to the invention.

The embodiment of an apparatus partly shown in FIGS. 1 and 2 for collecting, assembling and inserting printery products 10 has a rectilinear processing path along which an essentially V-shaped receiving part 12 and a plurality of saddle-shaped supports 14, arranged one behind the other and driveable in conveying direction F, are provided.

Each saddle-shaped support 14 consists of a number of equal segments 18 fixed one behind the other on a conveyor chain 16 which can be driven in a circulating manner in conveying direction F. Drivers 20 protruding on both sides are arranged in each case on the rearmost segment 18 of each support 14 At the start and end of the processing path, the endless conveyor chain 16 is guided around drive and return sprocket wheels in a manner not shown but known. Segmenting the supports 14 permits this return of the conveyor chain 16. Provided on both sides of the conveyor chain 16 are guide plates 24, 24' which are arranged in a fixed position on a frame 22 and are in alignment with the lateral flanks 26, directed downward at an angle, of the segments 18 or are covered by these flanks 26.

A further conveying chain 28 having driving parts 30 protruding laterally to the outside is provided along the lower end of the left hand guide plate 24 (as viewed in conveying direction F). This endless conveyor chain 28 can also be driven in a circulating manner in arrow direction F and is returned and driven at the start and end of the processing path in the same way as the conveyor chain 16. The guide plate 24 forms an upper part of the side wall of the receiving part 12 adjacent to the supports 14, the lower part of which receiving part 12 is formed by a shorter side flank 32 of a further guide plate 34 bent eccentrically in a V-shape. The conveyor chain 28 is thus covered by the guide plate 24, and the driving parts 30 arranged on this conveyor chain 28 protrude into the V-shaped receiving part 12 through the gap formed by the guide plate 24 and the side flank 32. The guide plates 24', 24 and 34, together with the segments 18, essentially have the shape of a reclining Z in cross-section.

The printery products 10, 10' shown by dot-dash lines in FIGS. 1 and 2 are folded printed sheets which are either deposited astride onto the supports 18 or are fed, with their fold 36 downward, into the receiving part 12. As viewed in arrow direction F, a single printery product 10 is located on the first support 18 shown, two printery products 10 are located on the second support 18 and three printery products 10 are located on third and fourth support 18. Shown by dot-dash lines in the left-hand end area of FIG. 1 is a printery product 10' which is fed into the receiving part 12.

The apparatus shown in FIGS. 1 and 2 functions as follows: to collect printery products 10, only the conveyor chain 16 having the supports 14 is driven in a circulating manner in conveying direction F. At a first feed location situated at the first support 14 (as viewed in arrow direction F in FIG. 1), a first printery product 10 is deposited astride onto this support 18. The trailing edge of this printery product 10 comes to bear against the corresponding driver 20 and is driven along in arrow direction F to the next feed location, where a further printery product 10 is deposited astride onto the first printery product 10 already deposited onto the supports 18. This second feed location is at the same place in FIG. 1 as the second support 18 (as viewed in arrow direction F). These two printery products 10, now lying one on top of the other, are transported to the next feed location, where a further printery product is placed on top. The so superposed printery products 10 are conveyed in arrow direction F to a removal location (not shown), where these printery products 10 are removed together from the supports 18 and fed to a further processing means.

To insert printery products 10, the conveyor chain 16 can be stopped, while the conveyor chain 28 having the driving parts 30 protruding into the receiving part 12 is driven in arrow direction F. At the first feed location, a folded printery product 10', with its fold 36 downward, is now fed into the receiving part 12. A driving part 30 driven in arrow direction F now acts on the trailing edge of this printery product 10' and conveys it past a generally known opening device (not shown) to the second feed location, where, in a known manner (but not shown), a further printery product 10' is fed into the opened printery product 10'. These printery products 10' are then taken together to the next feed location or to the removal location, arranged downstream in arrow direction F, at which the printery products 10' inserted one into the other are removed from the receiving part 12 and fed to further processing means (not shown). It should be noted that only the first printery product 10' has to be folded; the further printery products inserted into this first printery product 10' can be non-folded printery products.

During the assembly of printery products 10', these folded printery products are fed in the closed state at the feed locations into the receiving part 12 and, facultatively, placed next to the printery products 10' already present in this receiving part 12. In an analogous manner, as described further above, the printery products 10', thus lying side by side, are conveyed by the driving parts 30 along the processing path to the removal location.

The embodiment of the apparatus shown in FIGS. 3 and 4 for collecting, assembling and inserting printery products 10, 10' has an endless conveyor chain 40 which is guided along the processing path and is driveable in a circulating manner in arrow direction F and to which saddle-shaped supports 42, orientated with their longitudinal extension in the direction of the conveyor chain 40, are fixed one behind the other. Provided on the right-hand side (as viewed in arrow direction F) of the conveyor chain 40 is a fixed guide plate 44 whose upper margin is covered by the supports 42 (see in particular FIG. 4). On each support 42, an essentially V-shaped receiving part 46 is arranged in a suspended manner on the left-hand side. These receiving parts 46 consist of rectangular plates bent eccentrically in a V-shape, each of the longer side flanks 48, in their end area remote from the bend, having a hook-shaped form bent in the opposite direction, by means of which the receiving parts 46 are hung on the respective supports 42. A driving part 50 for the printery products 10' fed into the receiving parts 46 is provided between the two side flanks 48, 48' on the trailing end (as viewed in arrow direction F). In the lower end area, the suspended receiving parts 46 are supported by a guide rail 54 arranged in a fixed position on a frame 52 and acting on the longer side flank 48. The longer side flank, likewise at the upper, trailing end area, has a further driver 56, protruding from the supports 42, for the printed sheets 10 deposited astride.

The guide plate 44, together with the receiving parts 46, thus has a cross-section similar to a reclining Z, the printery products 10, during collecting, being deposited in this case onto the side flanks 48 bent in the upper end area. These side flanks 48 thus form the saddle-shaped supports for the printery products 10. The first two receiving parts 46 (as viewed in conveying direction F in FIG. 3) are situated in the same places as two feed locations at which in each case, when printery products 10 are being collected, these printery products 10 are deposited astride onto the supports or, when printery products 10' are being inserted or collected, these printery products 10' are fed into the receiving parts 46.

The apparatus shown in FIGS. 3 or 4 for collecting, assembling and inserting printery products 10, 10' functions as follows: during the collection of printery products 10, a printery product 10 is deposited astride at the first feed location onto the support formed by the side flank 48, the trailing edge of this printery product 10 coming to bear against the driver 56. This printery product 10 is driven along in arrow direction F to the next feed location, where a further printery product 10 is deposited thereupon in the same manner. The two printery products 10, thus lying one on top of the other, are fed in arrow direction F to a further feed location or the withdrawal location arranged downstream from the latter. During the insertion of printery products 10', a first, folded printery product 10', with its fold 36 in front, is fed at the first feed location into a receiving part 46. This printery product 10' is driven along in arrow direction F, the driving part 50 ensuring that it cannot slide out of the receiving part 46. At the next feed location, a further printery product 10' is now fed into this first printery product 10' opened by means of a generally known (but not shown) opening device, which printery products 10' are then conveyed together in arrow direction F to the next feed location or to the withdrawal location arranged downstream from the latter. During the assembly of printery products 10', these printery products 10' are deposited at the feed locations into the receiving parts 46 next to the printery products 10' already fed into the latter.

If printery products 10 are only to be collected with the apparatus shown in FIGS. 3 and 4, this can be done as described above. But it is also possible for the receiving parts 46 to be removed from the supports 42 so that the printery products 10 now to be collected are deposited astride onto the supports 42 fixed to the conveyor chain 40. If printery products 10 are then to be assembled or inserted again later, the receiving parts 46 can again be hung on the supports 42.

It is also conceivable for a single support and a single receiving part to be arranged in a fixed position and preferably for a single conveyor chain to be provided which has drivers which act on the printery products deposited onto the support or fed into the receiving part and drive these printery products along in a sliding manner on the support or in the receiving part.

It is also conceivable for the receiving part to form a self-contained channel or for the support to form a self-contained guide and for the endless conveyor chains having the drivers or driving parts to be driven in a circulating manner along this channel or the guide. Such a design has the advantage that the same printery products 10, 10' can passthrough the same processing path several times in order to collect, assemble or insert one into the other, for example, a plurality of identical printery products 10, 10'. It is of course also possible for only a single conveyor chain having drivers to be provided, the drivers acting on all printery products 10, 10'.

But it is also possible for a single receiving part and a single support to be provided which can be transported along the processing path by means of a drive arrangement. If the receiving part and the support extend along a horizontal, circular path, they are driven rotationally around a central, vertical axis, and the printery products 10, 10', at the feed locations provided at the periphery of this circular arrangement are deposited into the support or fed into the receiving part and are driven along by the support or receiving part to the next feed location or to the withdrawal location.

Figure 6:
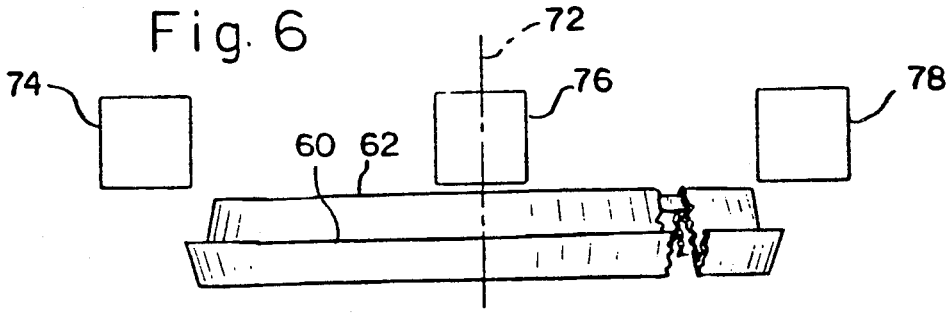
FIG. 6 shows a schematic top view of the embodiment of FIG. 5.
Figure 7:
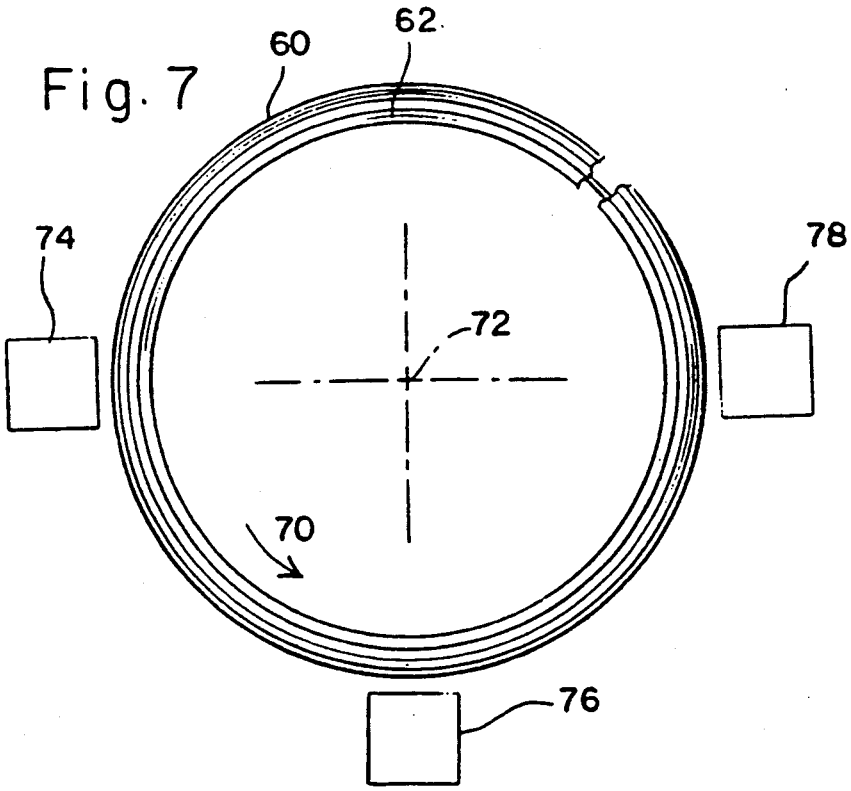

Referring now to FIG. 5 and FIG 6, it is also possible for a single receiving part 60 and a single support 62 to be provided which can be transported along the processing path 70 by means of a drive arrangement. If the receiving part 60 and the support 62 extend along a horizontal, circular path 70, they are driven rotationally about a central, vertical axis 72, and the printery products 10, 10', at the feed locations 74, 76 provided that the periphery of this circular arrangement are deposited into the support 62 or fed into the receiving part 60 and are driven along by the support 62 or the receiving part 60 to the next feed location 76 or to the withdrawal location 78.

It is also conceivable, for example, for the supports arranged on the conveyor chain to be removable and for receiving parts to be fixed to the conveyor chain in place of the supports. In any case, it is possible with all embodiments shown, if necessary after change-over conversion the apparatus, to collect, insert or assemble printery products 10, 10'.

For completeness it should also be mentioned that known feeders can be provided at the feed locations to feed the printery products 10, 10'. But it is also conceivable for the printery products 10, 10' to be transported to the feed locations by means of conveying apparatuses.

Furthermore, a single fixed support can be provided which runs along the preferably rectilinear processing path. A tension member acts on supports displaceable along the processing path or on the printery products deposited onto the supports. The tension member and the receiving parts are preferably returned from the end of the processing path to the start of the processing path on a return path separate from the processing path.

I claim:

1. An apparatus for collecting, assembling and inserting printery products comprising:

at least one support, extending in the direction of a processing path, for collecting printery products, which support is operative to support printery products deposited astride the support at two or more feed locations arranged at a distance from one another;

transporting means for transporting the printery products deposited astride the support along the processing path from the feed locations to a withdrawal location, wherein the transporting means acts on the region of the fold of the printery product deposited astride;

at least one pocket-shaped receiving part, which extends in the direction of the processing path, which is closed off at a bottom portion, and into which printery products can be fed at the feed locations for assembling or inserting; and conveying means separate from the transporting means for transporting the printery products fed into the at least one receiving part along the processing path, wherein the conveying means acts on the region of the fold of the preintery product fed into the receiving part.

2. The apparatus as claimed in claim 1, further comprising holding arrangements to which at least one of the support and the receiving part are removably secured.

3. The apparatus as claimed in claim 1, wherein a single support and a single receiving part are provided which are in a fixed position and run along the entire processing path, and wherein the transporting and conveying means comprise drivers which are arranged on two circulating traction members and are adapted to act on the corresponding printery products.

4. The apparatus as claimed in claim 3 wherein the single receiving part and the single support establish the processing path as a closed path.

5. An apparatus for collecting, assembling and inserting printery products comprising:

at least one support, extending in the direction of a processing path, for collecting printery products, which support is operative to support printery products deposited astride the support at two or more feed locations arranged at a distance from one another;

transporting means for transporting the deposited printery products along the processing path from the feed locations to a withdrawal location, the transporting means comprising a traction member which is guided along the processing path, which is driven in a circulating manner, and on which the at least one support is arranged;

at least one pocket-shaped receiving part, which extends in the direction of the processing path, which is closed off at a bottom portion, and into which printery products can be fed at the feed locations for assembling or inserting, wherein the at least one pocket-shaped receiving part is removably arranged at least at one of the plurality of the supports; and conveying means for transporting the printery products fed into the at least one receiving part along the processing path.

6. The apparatus as claimed in claim 5 wherein the conveying means comprises drivers which are arranged on the traction member and are adapted to act on the printery products fed into the receiving part.

7. An apparatus for collecting, assembling and inserting printery products comprising:

a single support, extending in the direction of a processing path, for collecting printery products, which support is operative to support printery products deposited astride the support at two or more feed locations arranged at a distance from one another;

transporting means for transporting the deposited printery products along the processing path from the feed locations to a withdrawal location;

a single pocket-shaped receiving part, which extends in the direction of the processing path, which is closed off at a bottom portion, and into which printery products can be fed at the feed locations for assembling or inserting: and conveying means for transporting the printery products fed into the at least one receiving part along the processing path;

wherein the transporting and conveying means comprise a drive arrangement for the receiving part and the support; and further wherein the support and the receiving part extend along an essentially horizontal, closed and circular path, wherein they are rotatably driveable about a central, at least almost perpendicular axis by means of the drive arrangement, and wherein the feed and withdrawal locations are provided at respective stationary positions in a peripheral area of the circular path.

8. The invention of claim 5 wherein the processing path is substantially rectilinear.

9. The apparatus as claimed in claim 5 further comprising a plurality of receiving parts the are essentially V-shaped and arranged in a suspended manner on each support of the plurality of supports.

10. The appartatus as claimed in claim 5 further comprising a plurality of receiving parts, wherein the receiving parts comprise essentially rectangular plates bent into a V-shape and wherein one of the side flanks of each plate, in the area remote from the bend, comprises a hook shaped means by which the receiving parts are suspended on the respective supports.

11. The apparatus as claimed in claim 9 or 10 further comprising a guide means for supporting the suspended receiving parts in a lower end area.

12. The apparatus as claimed in claim 1 or 2 or 3 or 5 or 6, wherein the processing path is rectilinear, and wherein the transporting and conveying means are guided along a return path from the end of the processing path to the start of the processing path.

* * * * *

UNITED STATES PATENT AND TRADEMARK OFFICE
CERTIFICATE OF CORRECTION

PATENT NO. : 5,116,033

DATED : May 26, 1992

INVENTOR(S) : Werner Honegger

It is certified that error appears in the above-identified patent and that said Letters Patent is hereby corrected as shown below:

On title page, item [30], "Foreign Application Priority Data", delete "02284/88" and substitute therefor --02284/88-1--.

Column 4, line 56, after "10'", please insert --,--.

Column 5, line 19, delete "passthrough" and substitute therefor --pass through--.

Column 5, lines 26-36, please delete the paragraph:

"But it is also possible for a single receiving part and a single support to be provided which can be transported along the processing path by means of a drive arrangement. If the receiving part and the support extend along a horizontal, circular path, they are driven rotationally around a central, vertical axis, and the printery products 10, 10', at the feed locations provided at the periphery of this circular arrangement are deposited into the support or fed into the receiving part and are driven along by the support or receiving part to the next feed location or to the withdrawal location."

UNITED STATES PATENT AND TRADEMARK OFFICE

CERTIFICATE OF CORRECTION

PATENT NO. : 5,116,033

DATED : May 26, 1992

INVENTOR(S) : Werner Honegger

It is certified that error appears in the above-identified patent and that said Letters Patent is hereby corrected as shown below:

Column 6, claim 1, line 27, delete "preintery" and substitute therefor --printery--.

Column 8, claim 9, line 9, delete "the" and substitute therefor --that--.

Signed and Sealed this

Twelfth Day of April, 1994

Bruce Lehman

*Attest:*

BRUCE LEHMAN

*Commissioner of Patents and Trademarks*

*Attesting Officer*